US006957600B2

(12) United States Patent
Hu

(10) Patent No.: US 6,957,600 B2
(45) Date of Patent: Oct. 25, 2005

(54) ADJUSTABLE HEAD FOR A WRENCH

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 354 days.

(21) Appl. No.: 10/421,341

(22) Filed: Apr. 23, 2003

(65) Prior Publication Data

US 2004/0144217 A1 Jul. 29, 2004

(30) Foreign Application Priority Data

Jan. 28, 2003 (TW) ..... 92102139 A

(51) Int. Cl.[7] ..... B25B 23/16
(52) U.S. Cl. ..... 81/177.8; 81/177.7
(58) Field of Search ..... 81/177.8, 177.9, 81/177.6, 177.7

(56) References Cited

U.S. PATENT DOCUMENTS 6,000,302 A * 12/1999 Chiang ..... 81/177.8
6,131,490 A * 10/2000 Lee ..... 81/63.1
6,216,567 B1 * 4/2001 Hu ..... 81/177.9
6,295,898 B1 * 10/2001 Hsieh ..... 81/177.8

* cited by examiner

*Primary Examiner*—David B. Thomas
(74) *Attorney, Agent, or Firm*—Alan D. Kamrath; Nikolai & Mersereau, P.A.

(57) ABSTRACT

A wrench includes a handle, a head having a pivotal portion pivotably connected to an end of the handle, and a retaining mechanism for allowing the head to be pivotally moved to a desired position relative to the handle and retaining the head in the desired position. The pivotal portion of the head includes a fore part and a rear part with reference to a ratcheting direction of the handle. The fore part includes an arcuate outer surface section. The rear part includes a toothed section having a plurality of teeth. The toothed section has a dedendum circle located inside an area delimited by the arcuate outer surface section. Thus, the thickness of the fore part is not reduced, preventing damage to the torque-bearing section in the fore part during operation.

19 Claims, 13 Drawing Sheets

ADJUSTABLE HEAD FOR A WRENCH

BACKGROUND OF THE INVENTION

1. Field of the Invention

The present invention relates to an adjustable head for a wrench. In particular, the present invention relates to a wrench including a handle and a head that can be pivotally adjusted to and retained in a desired position relative to the handle.

2. Description of the Related Art

FIGS. 1 through 3 of the drawings illustrate a conventional wrench that includes a handle 1 and a head 10 that can be pivotally adjusted to a desired position relative to the handle 1, as disclosed in, e.g., Taiwan Utility Model Publication No. 380468. The handle 1 includes a pair of lugs 2 on an end thereof, and a pin 3 is extended through aligned holes 4 in the lugs 2 and a pin hole 13 in a pivotal portion 11 of the head 10, thereby pivotally connecting the pivotal portion 11 of the head 10 to the lugs 2 of the handle 1. A plurality of teeth 12 is formed along an arcuate outer surface section of the pivotal portion 11 for releasably engaging with a pawl or catch 15 mounted in the end of the head 10. Thus, the head 10 moves together with the handle 1 for driving fasteners when the catch 15 is engaged with the teeth 12 of the head 10. And the head 10 can be pivoted to a desired position relative to the handle 10 when the catch 15 is disengaged from the teeth 12 of the head 10. In this wrench, formation of the teeth 12 formed along an entire arcuate outer surface section of the pivotal portion 11 causes a reduction in the thickness of the pivotal portion 11; namely, the distance from a periphery delimiting the pin hole 13 to the dedendum circle of the pivotal portion is "L". As illustrated in FIG. 1, the pivotal portion 11 is subjected to a torque at sections 13*a* and 13*b* when the wrench is turned along, e.g., clockwise for driving a fastener. It was found that cracks 14 are apt to be generated in the torque-bearing section 13*b*. The torque-bearing section 13*b* is damaged when the torque applied to the wrench is relatively large. The device for retaining the head in a desired position relative to the handle sacrifices the torque-bearing capacity of the wrench.

FIGS. 4 through 6 illustrate another conventional wrench that includes a handle 5 and a head 20 that can be pivotally adjusted to a desired position relative to the handle 5, as disclosed in, e.g., Taiwan Utility Model Publication No. 421111. The handle 5 includes a pair of lugs 6 on an end thereof, and a pin 7 is extended through aligned holes 8 in the lugs 2 and a pin hole 24 in a pivotal portion 21 of the head 20, thereby pivotally connecting the pivotal portion 21 of the head 20 to the lugs 6 of the handle 5. A plurality of teeth 22 is formed along an arcuate outer surface section of a left part (FIG. 5) of cylindrical section of the pivotal portion 21 for releasably engaging with a pawl or catch 26 mounted in the end of the head 20. Thus, the head 20 moves together with the handle 5 for driving fasteners when the catch 26 is engaged with the teeth 22 of the head 20. And the head 20 can be pivoted to a desired position relative to the handle 20 when the catch 26 is disengaged from the teeth 22 of the head 20 by means of sliding the catch 26 to a right part of the cylindrical section of the pivotal portion 21. An arcuate outer surface section 23 of the right part of the pivotal portion 21 must have a profile slightly lower than the dedendum circle of the teeth 22 to allow sliding movement of the catch 26 along a direction transverse to a longitudinal direction of the handle 5. Namely, the catch 26 cannot be slid to the right part of the pivotal portion 21 if the right part of the pivotal portion 21 has a profile higher than the dedendum circle of the teeth 22. Hence, the thickness of the right portion of the pivotal portion 21 is reduced, and the distance from a periphery delimiting the pin hole 24 to the arcuate outer surface section 23 of the pivotal portion is "$L_1$", which is smaller than "L" in the above wrench. As illustrated in FIG. 4, the pivotal portion 21 is subjected to a torque at sections 24*a* and 24*b* when the wrench is turned along, e.g., clockwise for driving a fastener. Similar to the above wrench, cracks 24 are apt to be generated in the torque-bearing section 24*b*, and the torque-bearing section 24*b* is damaged when the torque applied to the wrench is relatively large. In the wrench shown in FIGS. 4 through 6, the device for retaining the head in a desired position relative to the handle also sacrifices the torque-bearing capacity of the wrench.

SUMMARY OF THE INVENTION

An object of the present invention is to provide a wrench including a handle, a head having a pivotal portion pivotably connected to an end of the handle, and a retaining mechanism for allowing the head to be pivotally moved to a desired position relative to the handle and retaining the head in the desired position. The pivotal portion of the head includes a fore part and a rear part with reference to a ratcheting direction of the handle. The fore part includes an arcuate outer surface section. The rear part includes a toothed section having a plurality of teeth. The toothed section has a dedendum circle located inside an area delimited by the arcuate outer surface section. Thus, the thickness of the fore part is not reduced, preventing damage to the torque-bearing section in the fore part during operation.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
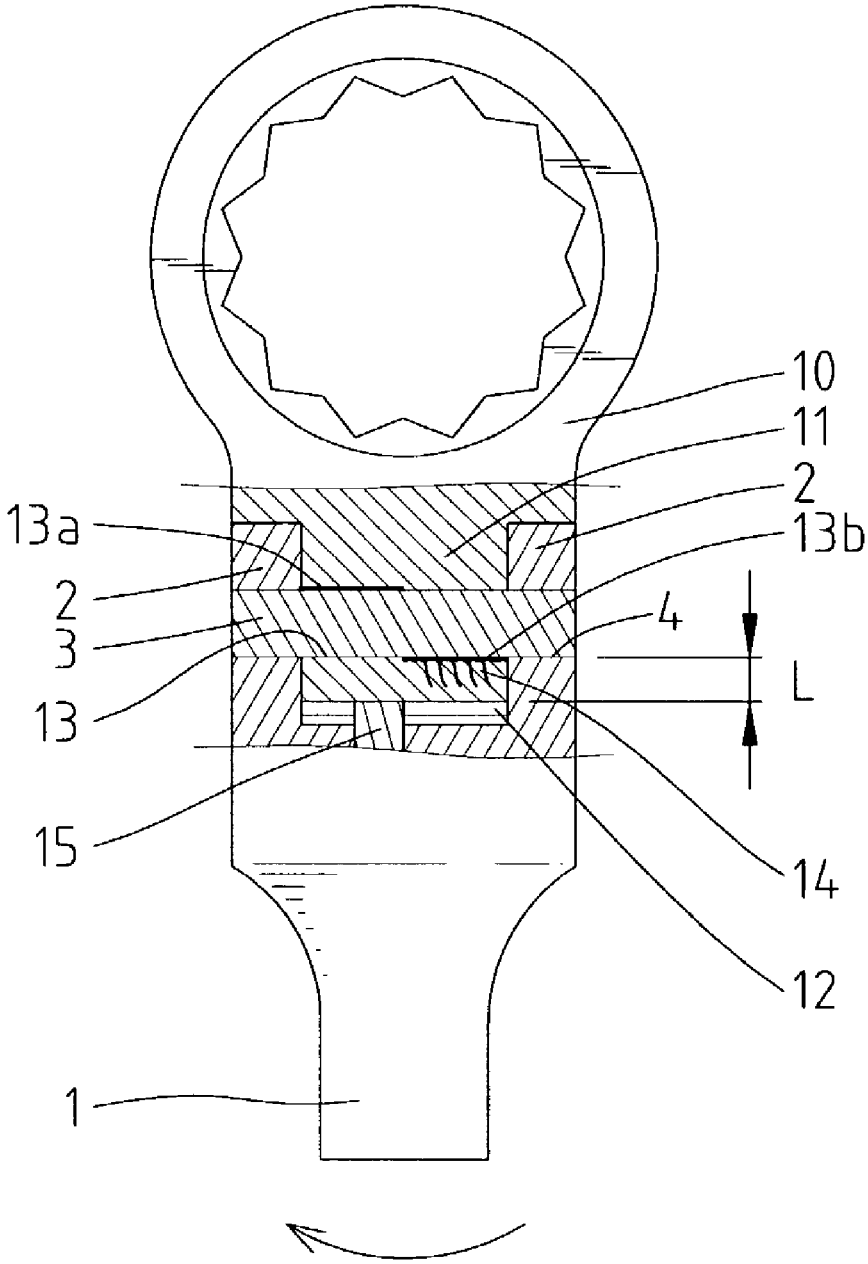
Fig. 1 PRIOR ART
FIG. 1 is a top view, partly sectioned, of a conventional wrench.
Figure 3:
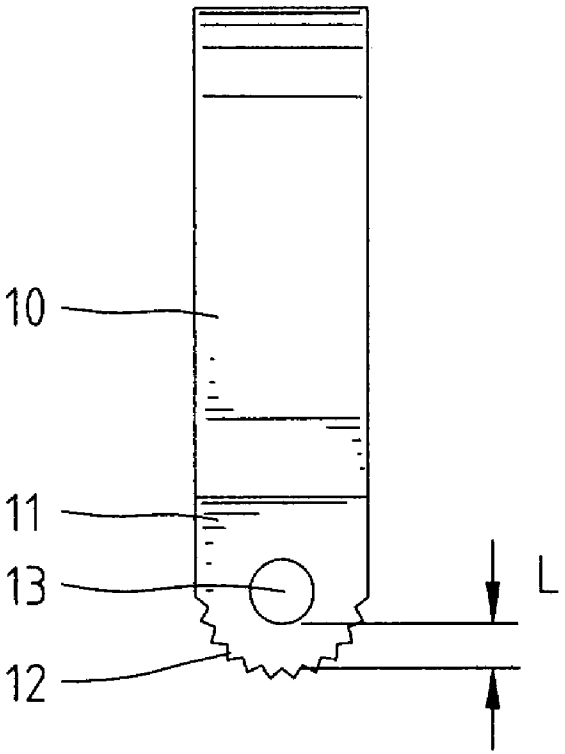
Fig. 3 PRIOR ART
FIG. 3 is a side view of the head in FIG. 2.
Figure 2:
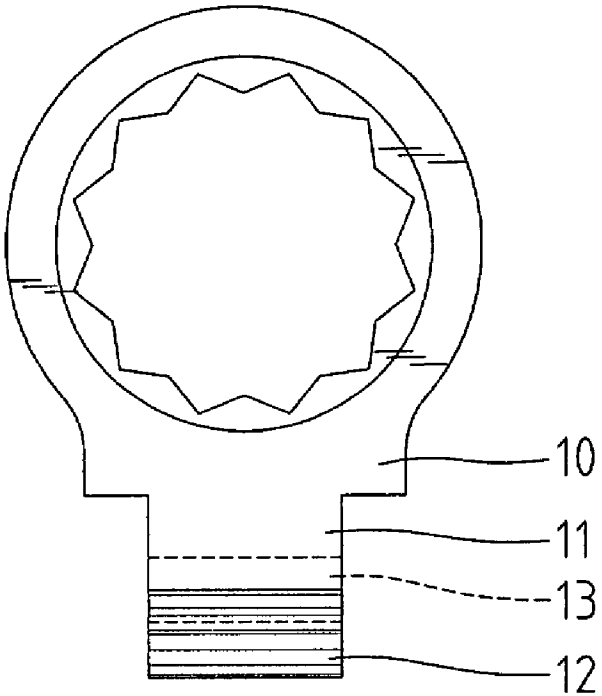
Fig. 2 PRIOR ART
FIG. 2 is a top view of a head of the wrench in FIG. 1.
Figure 4:
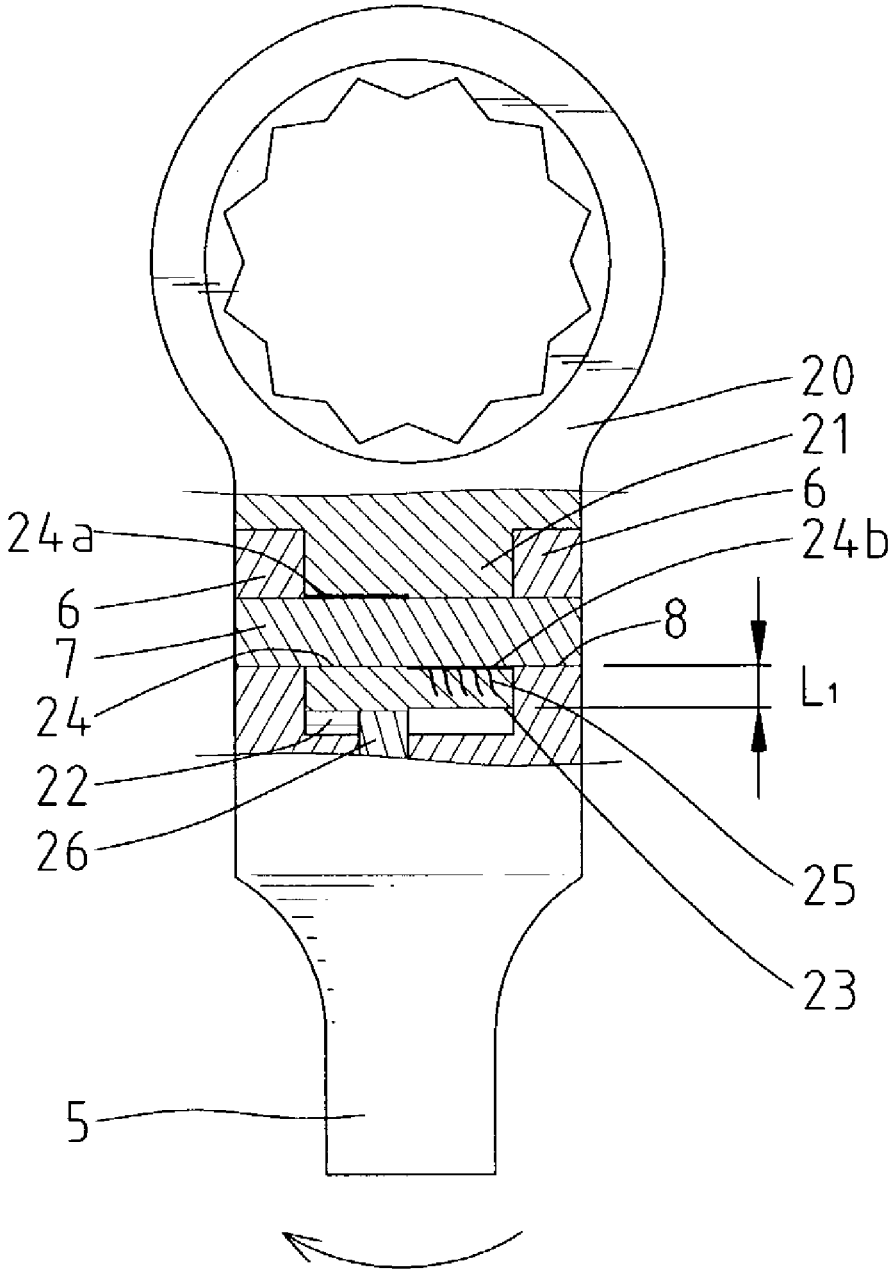
Fig. 4 PRIOR ART
FIG. 4 is a top view, partly sectioned, of another conventional wrench.
Figure 6:
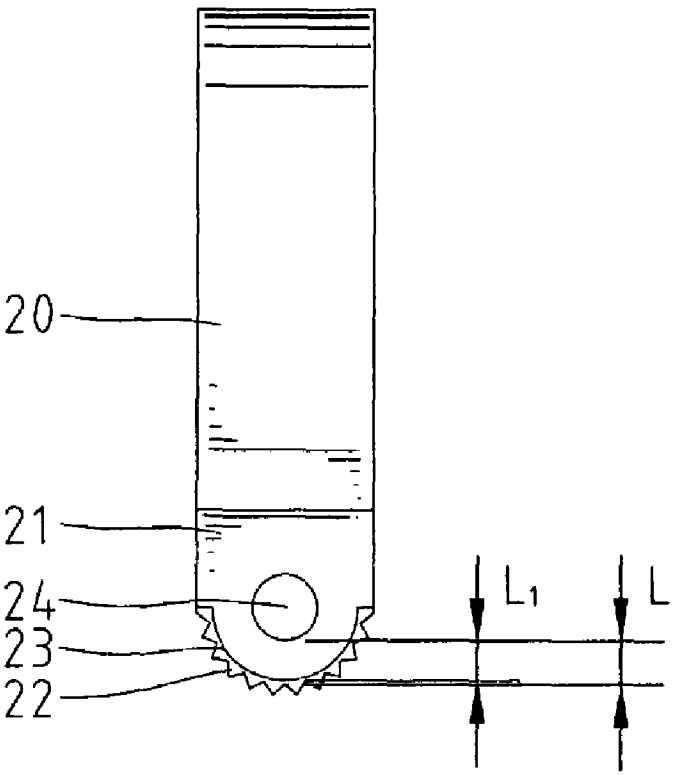
Fig. 6 PRIOR ART
FIG. 6 is a side view of the head in FIG. 5.
Figure 5:
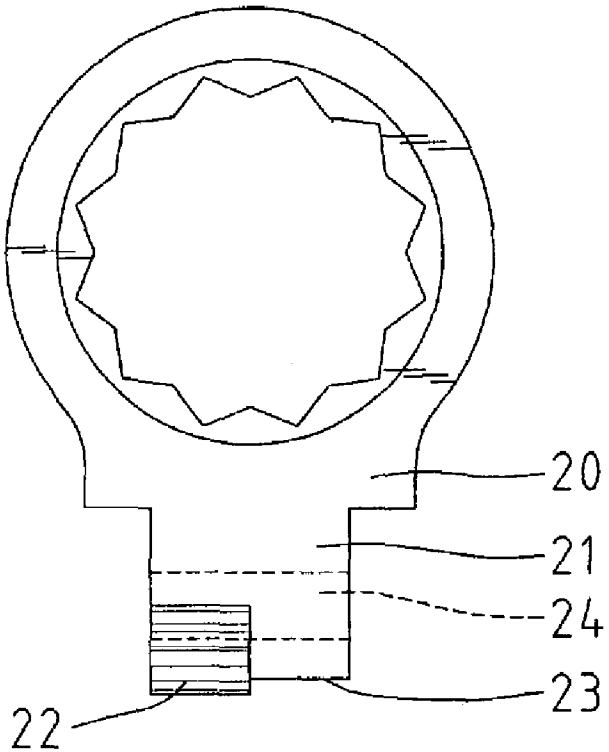
Fig. 5 PRIOR ART
FIG. 5 is a top view of a head of the wrench in FIG. 4.
Figure 7:
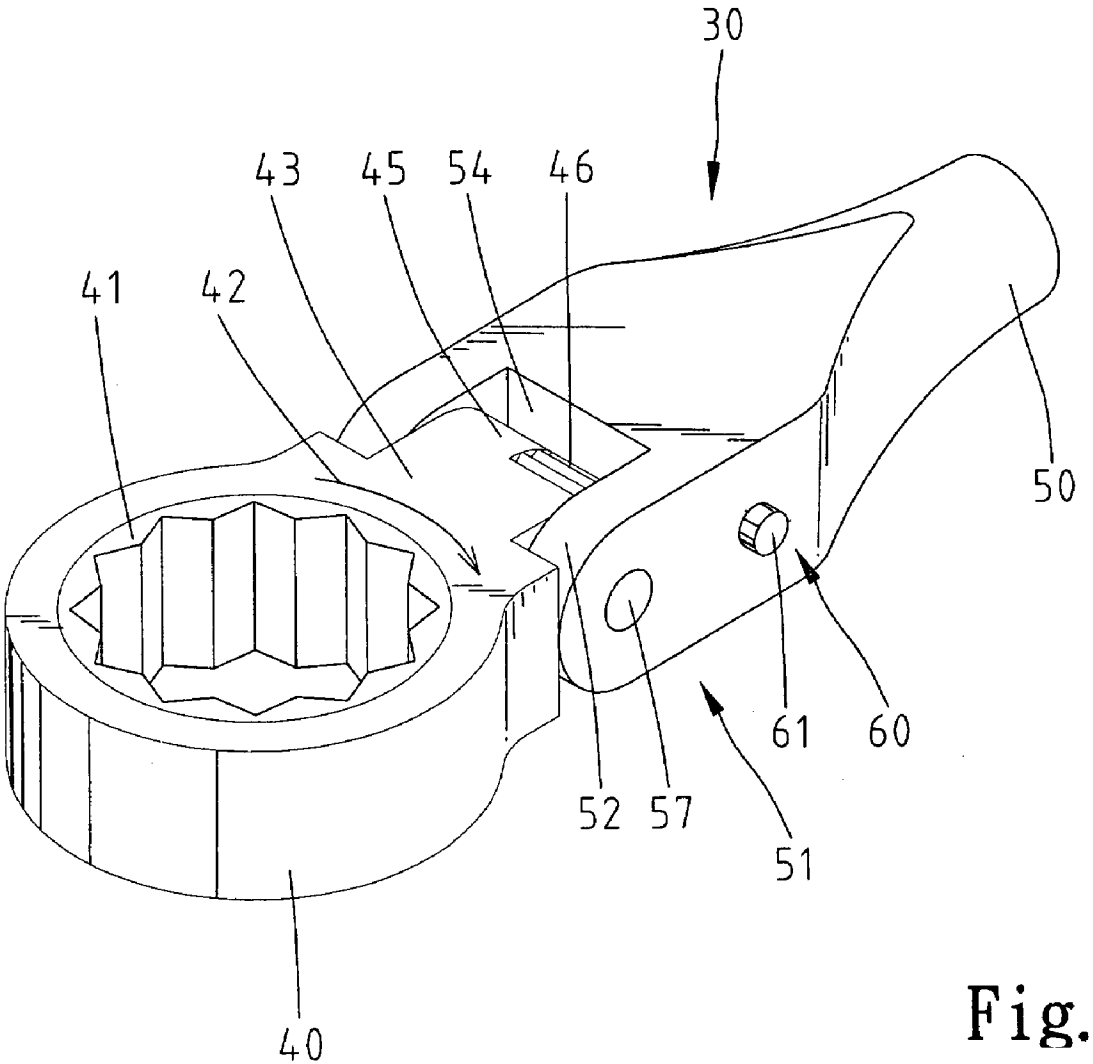
FIG. 7 is a perspective view of a wrench in accordance with the present invention.
Figure 8:
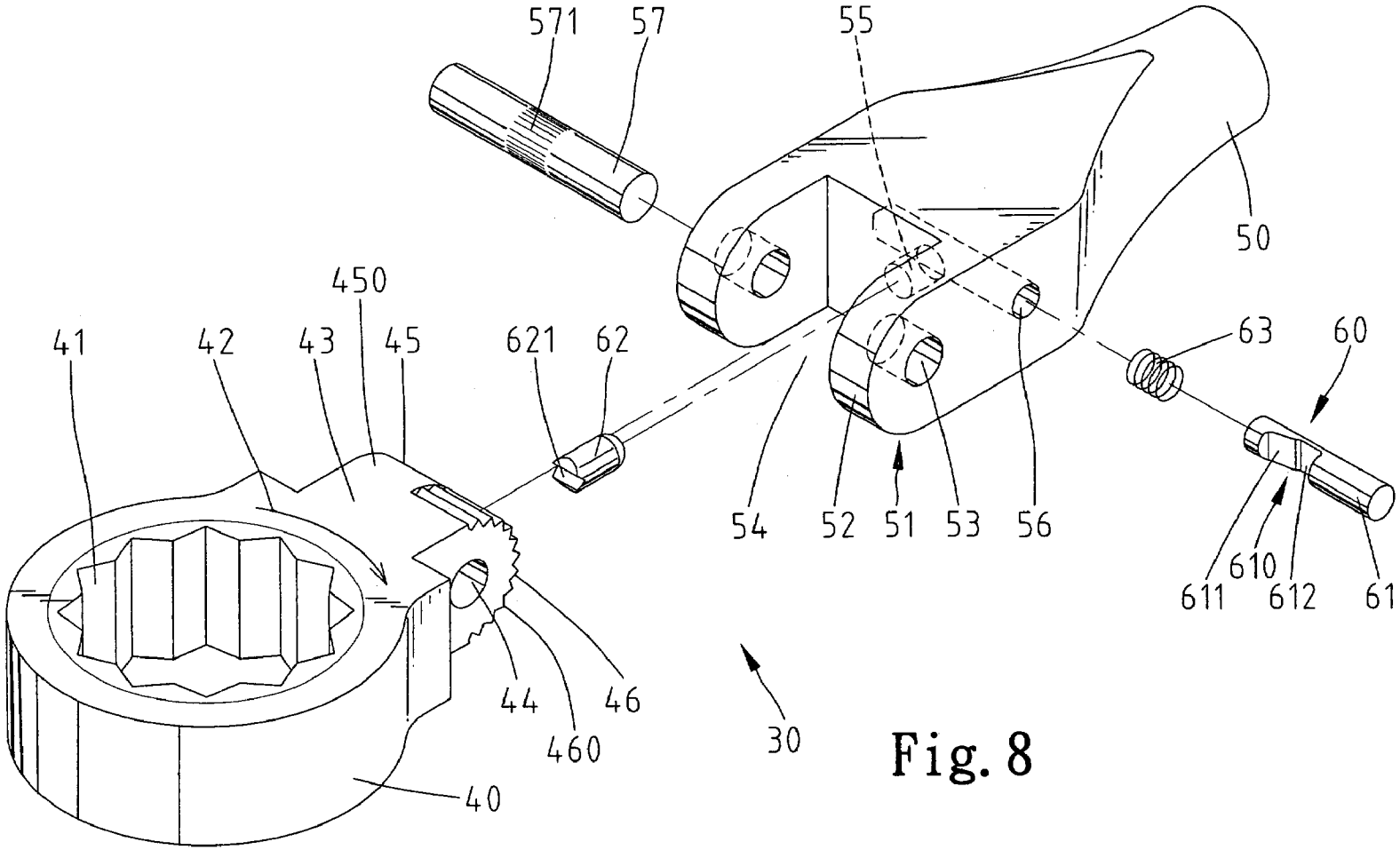
FIG. 8 is an exploded perspective view of the wrench in accordance with the present invention.

Referring to FIGS. 7 and 8, a wrench in accordance with the present invention generally comprises a handle 50 and a head 40 that can be pivotally adjusted to a desired position relative to the handle 50. The handle 50 includes an engaging portion 51 on an end thereof. In this embodiment, the engaging portion 51 includes a pair of lugs 52 having aligned holes 53, with an opening 54 being defined between the lugs 52.

The head 40 includes a drive member 41 mounted therein for driving fasteners, and a mark 42 is formed on a side of the head 40 for indicating ratcheting direction of the drive member 41. The head 40 further has a pivotal portion 43 extending from the head 40. The pivotal portion 43 is received in the opening 54 of the head 40 and includes a pin hole 44. A pin 57 is extended through the holes 53 in the lugs 52 and the pin hole 44 of the pivotal portion 43 of the head 40, thereby pivotally connecting the pivotal portion 43 of the head 40 to the lugs 52 of the handle 50. Preferably, the pin 57 has an embossed section 571 allowing the pin 57 to be tightly mounted in the pin hole 44.

The end of the handle 50 further has a receptacle 56 extending in a direction perpendicular to a longitudinal direction of the handle 50. An axial hole 55 is defined in the end of the handle 50 and communicated with the receptacle 56. A retaining mechanism 60 is provided for retaining the head 40 in a desired position relative to the handle 50 and includes an elastic element 63, a push member 61, and a catch 62. The elastic element 63 and the push member 61 are mounted in the receptacle 56, and the catch 62 is slidably mounted in the axial hole 55 and has a toothed portion 621 in an end thereof. The push member 61 includes a recessed portion 610 having a first face 611 and a second face 612, both facing the head 40. The first face 611 and the second face 612 are located at different heights, and the other end of the catch 62 is selectively engaged with one of the first face 611 and the second face 612. An end of the push member 61 is biased by the elastic element 63 to a position located beyond the receptacle 56 for manual operation.

Figure 10:
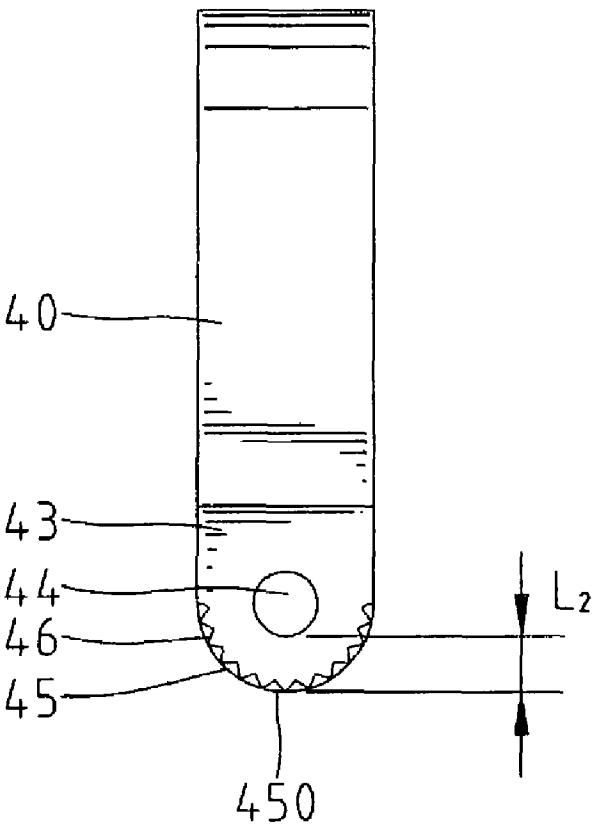
FIG. 10 is a side view of the head in FIG. 9.
Figure 9:
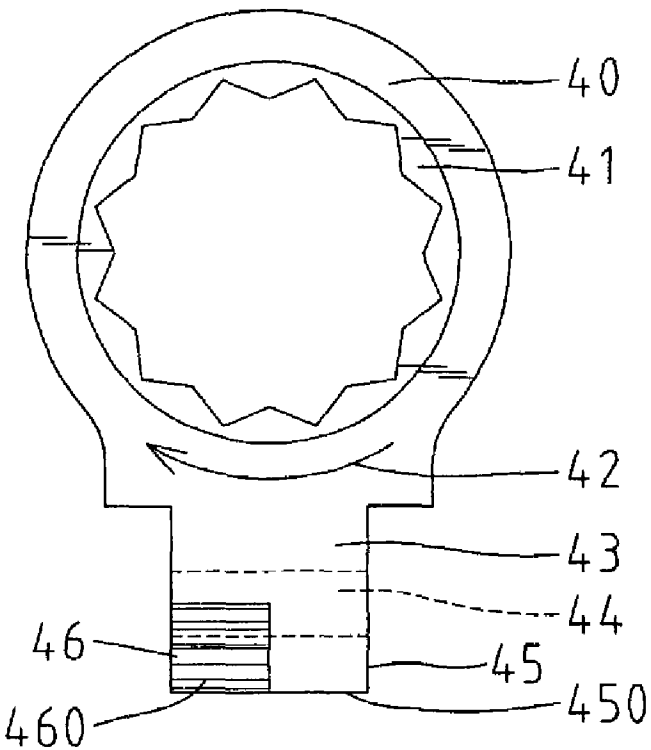
FIG. 9 is a top view of a head of the wrench in FIG. 7.

Referring to FIGS. 9 and 10, the pivotal portion 43 of the head 40 includes a first, fore part 45 and a second, rear part 46. The terms "fore" and "rear" used herein are referred to with reference of the ratcheting direction of the wrench (see the mark 42). Namely, the rear part 46 is located in front of the fore part 45 when viewed from the ratcheting direction of the handle 50 (i.e., the direction indicated by the mark 42). The rear part 46 of the pivotal portion 43 has a toothed section having a plurality of teeth 460 on an arcuate outer surface section thereof, and the fore part 45 of the pivotal portion 43 has a smooth arcuate outer surface section 450 without causing a reduction in the thickness. As illustrated in FIG. 10, a distance from a periphery delimiting the pin hole 44 to the arcuate outer surface section 450 of the fore part 45 of the pivotal portion 43 is "$L_2$", which is greater than "L" and "$L_1$" in the conventional wrenches of the same size. Further, the dedendum circle of the teeth 460 of the rear part 46 of the pivotal portion 43 is located inside an area delimited by the arcuate outer surface section 450 of the fore part 45 of the pivotal portion 43, as shown in FIG. 10.

Figure 11:
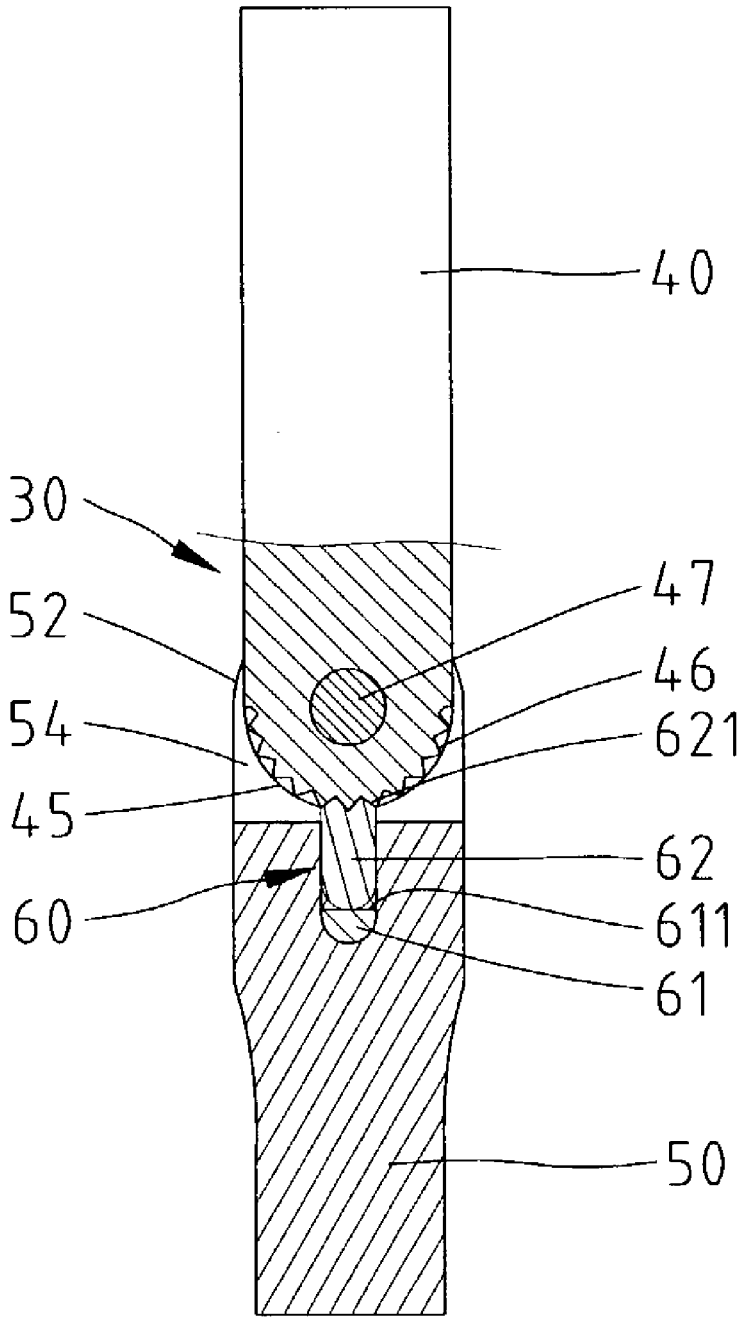
FIG. 11 is a side view, partly sectioned, of the wrench in FIG. 7.
Figure 12:
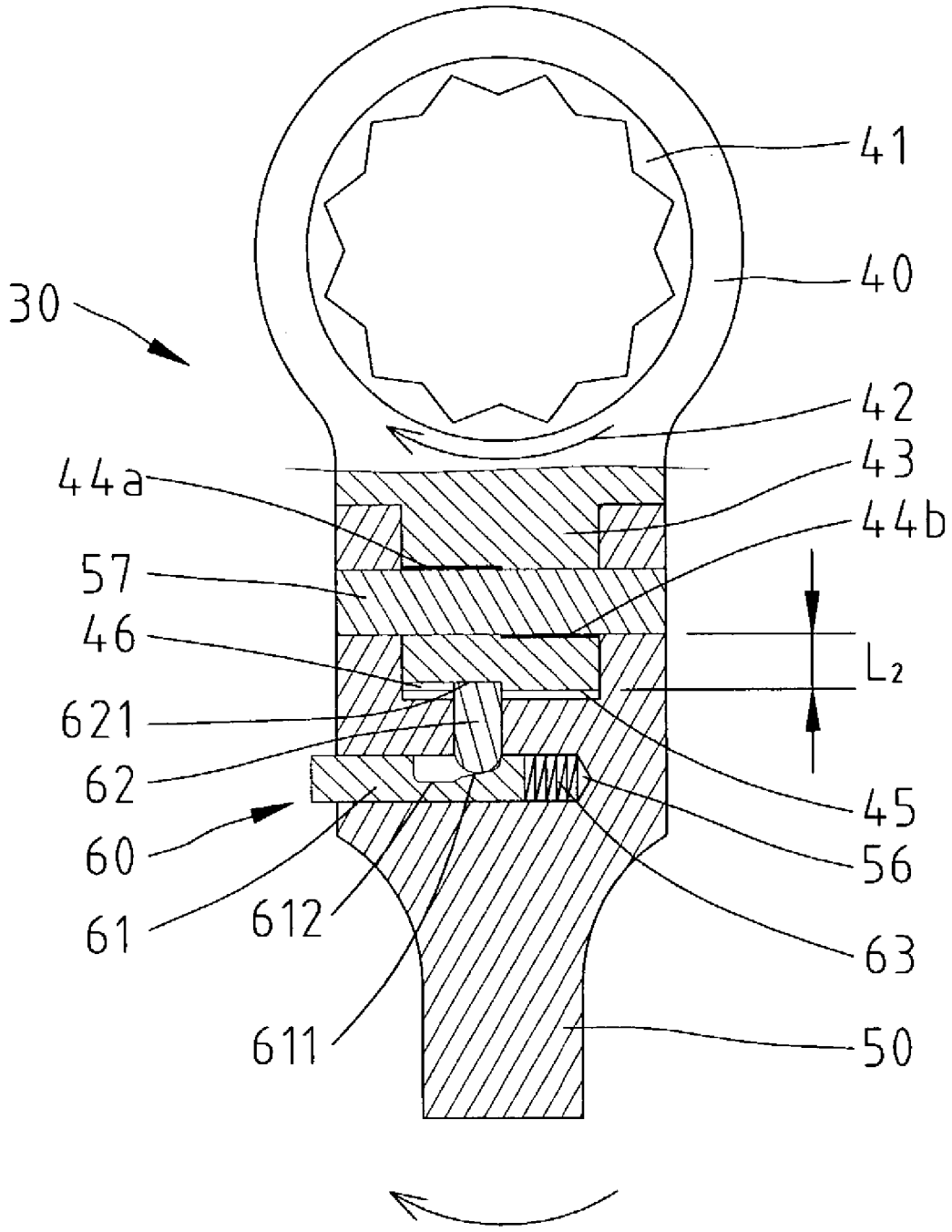
FIG. 12 is a top view, partly sectioned, of the wrench in FIG. 7.

In use, referring to FIGS. 11 and 12, the push member 61 is biased by the elastic element 63 such that the other end of the catch 62 is engaged with the first face 611 of the push member 61 and that the toothed portion 621 of the catch 62 is engaged with the teeth 460 of the pivotal portion 43 of the head 40. Thus, the head 40 is retained in a desired position relative to the handle 50, allowing joint rotation of the head 40 and the handle 50. When the push member 61 is pushed, the elastic element 63 is compressed, and the other end of the catch 62 is engaged with the second face 612 of the push member 61, and the toothed portion 621 of the catch 62 is allowed to be disengaged from the teeth 460 of the pivotal portion 43. Thus, the head 40 may be pivoted relative to the handle 50 until the head 40 reaches a desired position relative to the handle 50.

Still referring to FIG. 12, when turning the handle 50 clockwise, which is also the direction indicated by the mark 42 on the head 40, the head 40 turns together with the handle 50. The pivotal portion 43 is subjected to a torque at sections 44*a* and 44*b* when the wrench is turned clockwise for driving a fastener. Since the thickness of the fore part 45 of the pivotal portion 43 is not reduced, it is less likely to crack or damage the torque-bearing section 44*b*. Namely, the torque-bearing capacity of the wrench is not sacrificed even the head 40 is designed to be pivotably adjusted to a desired position relative to the handle 50. The drive member 41 is so configured that a fastener engaged with the drive member is tightened or loosened when the handle 50 is turned along the ratcheting direction indicated by the mark 42 and that the fastener is not turned when the handle 50 is turned along a direction opposite to the ratcheting direction. Such a drive member 41 is conventional and therefore not described in detail.

Figure 14:
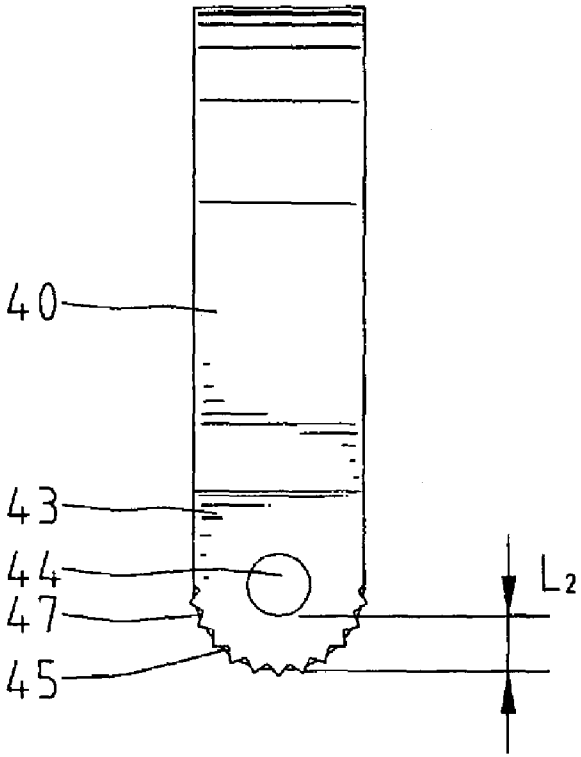
FIG. 14 is a side view of the head in FIG. 13.
Figure 13:
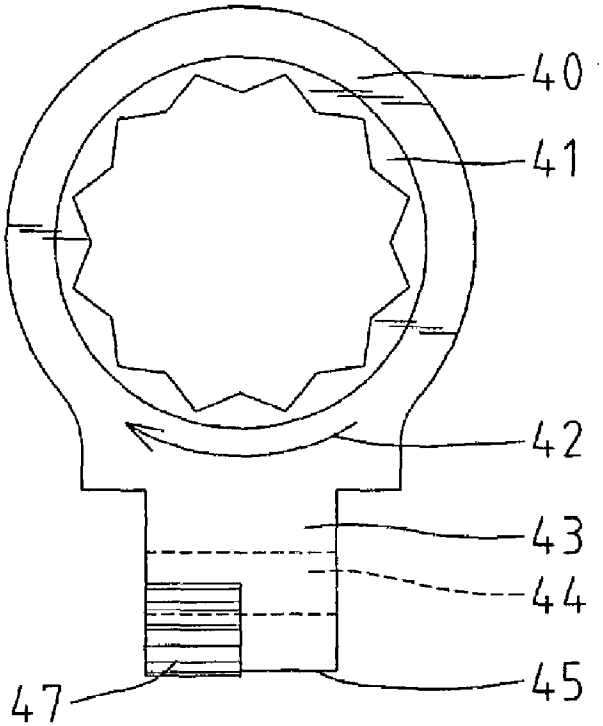
FIG. 13 is a top view of a modified embodiment of the head of the wrench in accordance with the present invention.
Figure 15:
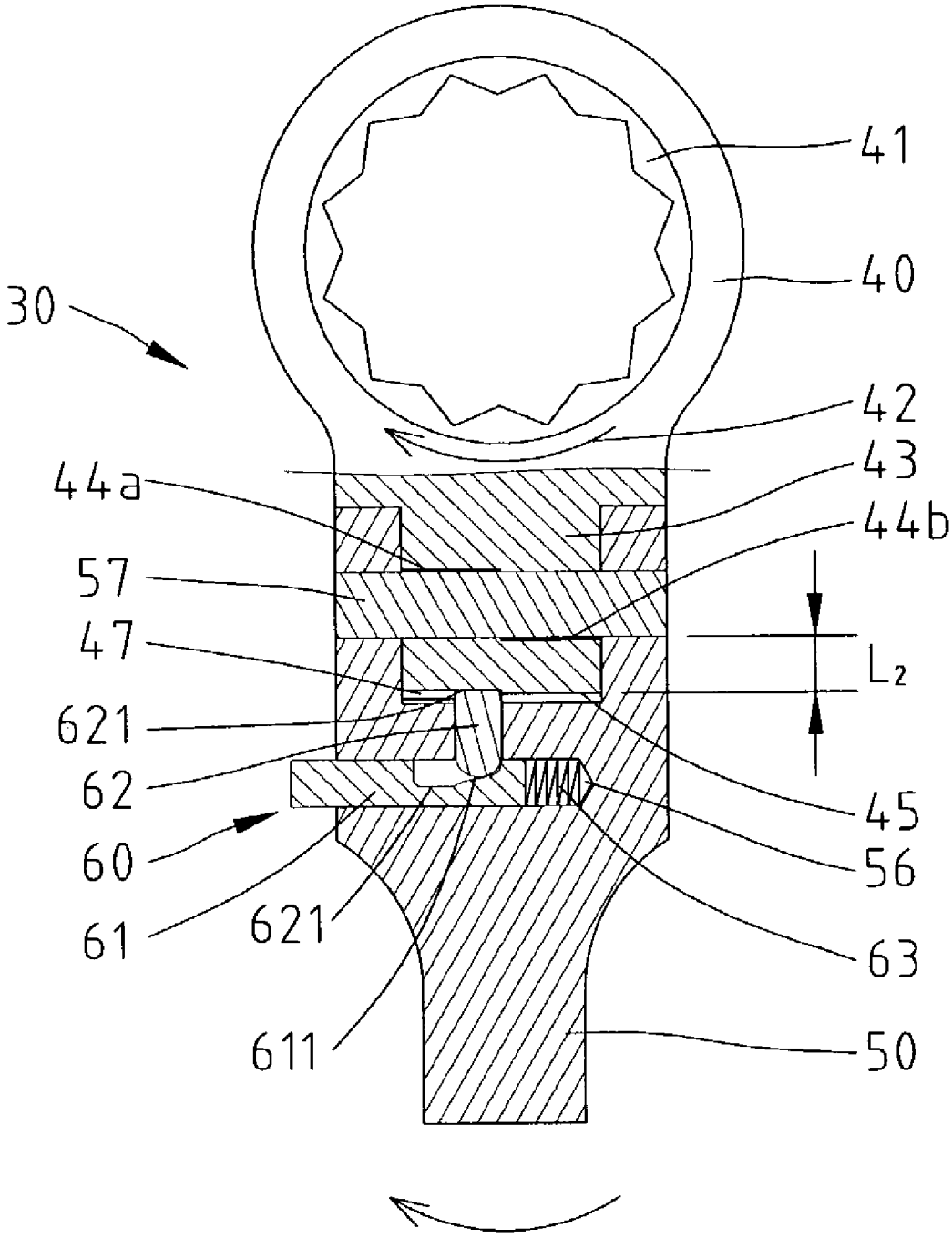
FIG. 15 is a top view, partly sectioned, of a wrench using the head in FIG. 13.

FIGS. 13 and 14 illustrate a modified embodiment of the head 40. The addendum circle of the teeth 460 of the first embodiment shown in FIGS. 8 through 12 is substantially flush with the arcuate outer surface section 450 of the fore part 45 of the pivotal portion 43. In the head 40 of the embodiment shown in FIGS. 13 and 14, the addendum circle of the teeth (now designated by 47) is located outside the area delimited by the arcuate outer surface section 450 of the fore part 45 of the pivotal portion 43, yet the dedendum circle of the teeth 47 of the rear part of the pivotal portion 43 is still located inside the area delimited by the arcuate outer surface section 450 of the fore part 45 of the pivotal portion 43. As illustrated in FIG. 14, a distance L2 from a periphery delimiting the pin hole 44 to the arcuate outer surface section 450 of the fore part 45 of the pivotal portion 43 remains unchanged. Thus, the torque-bearing capacity of the wrench is not sacrificed while allowing the head 40 to be pivotably adjusted to a desired position relative to the handle 50, as it is less likely to crack or damage the torque-bearing sections 44*b* when the handle 50 is turned along the ratcheting direction indicated by the mark 42, as shown in FIG. 15.

Figure 16:
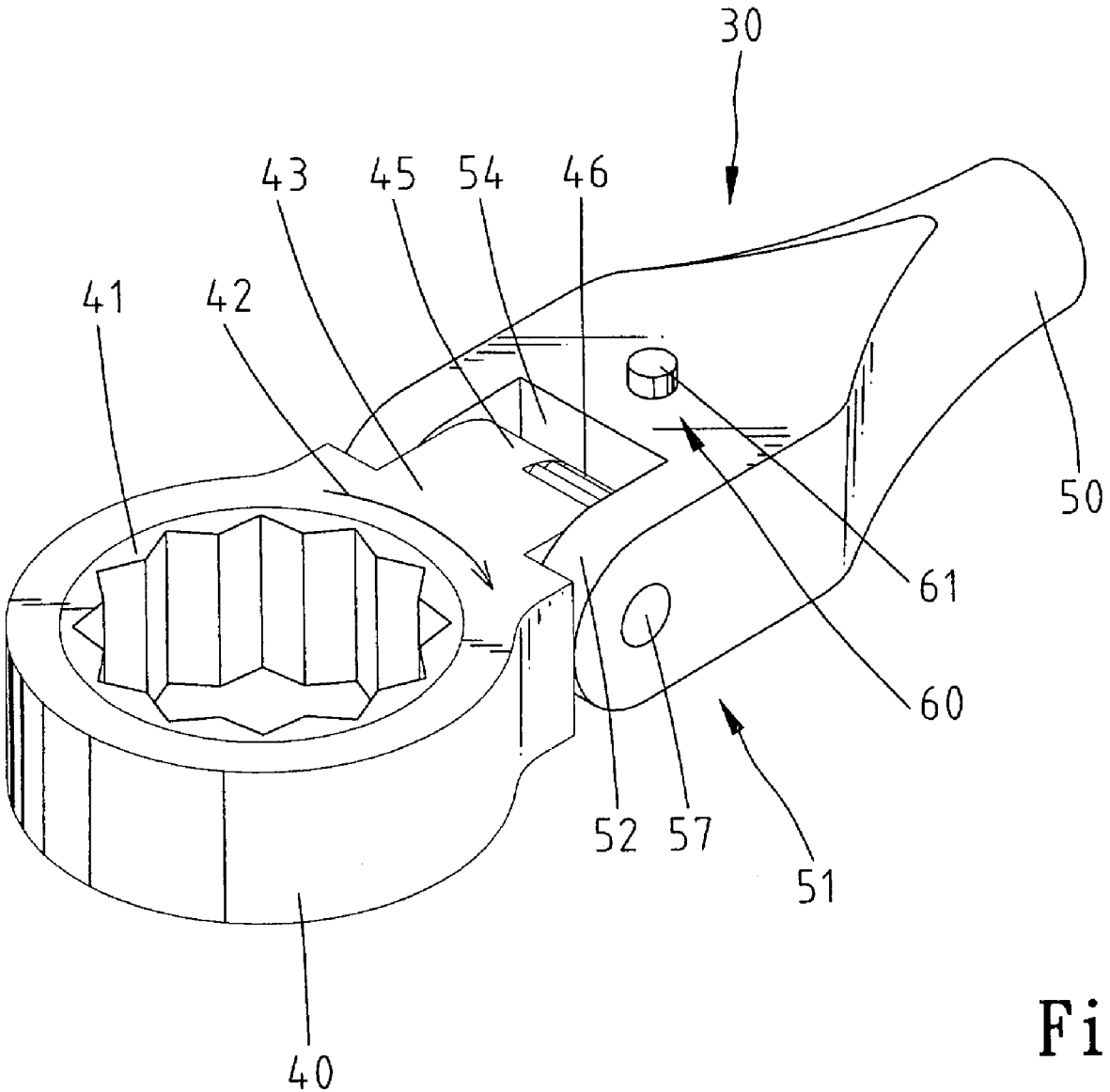
FIG. 16 is a perspective view of a further modified embodiment of the wrench in accordance with the present invention.
Figure 17:
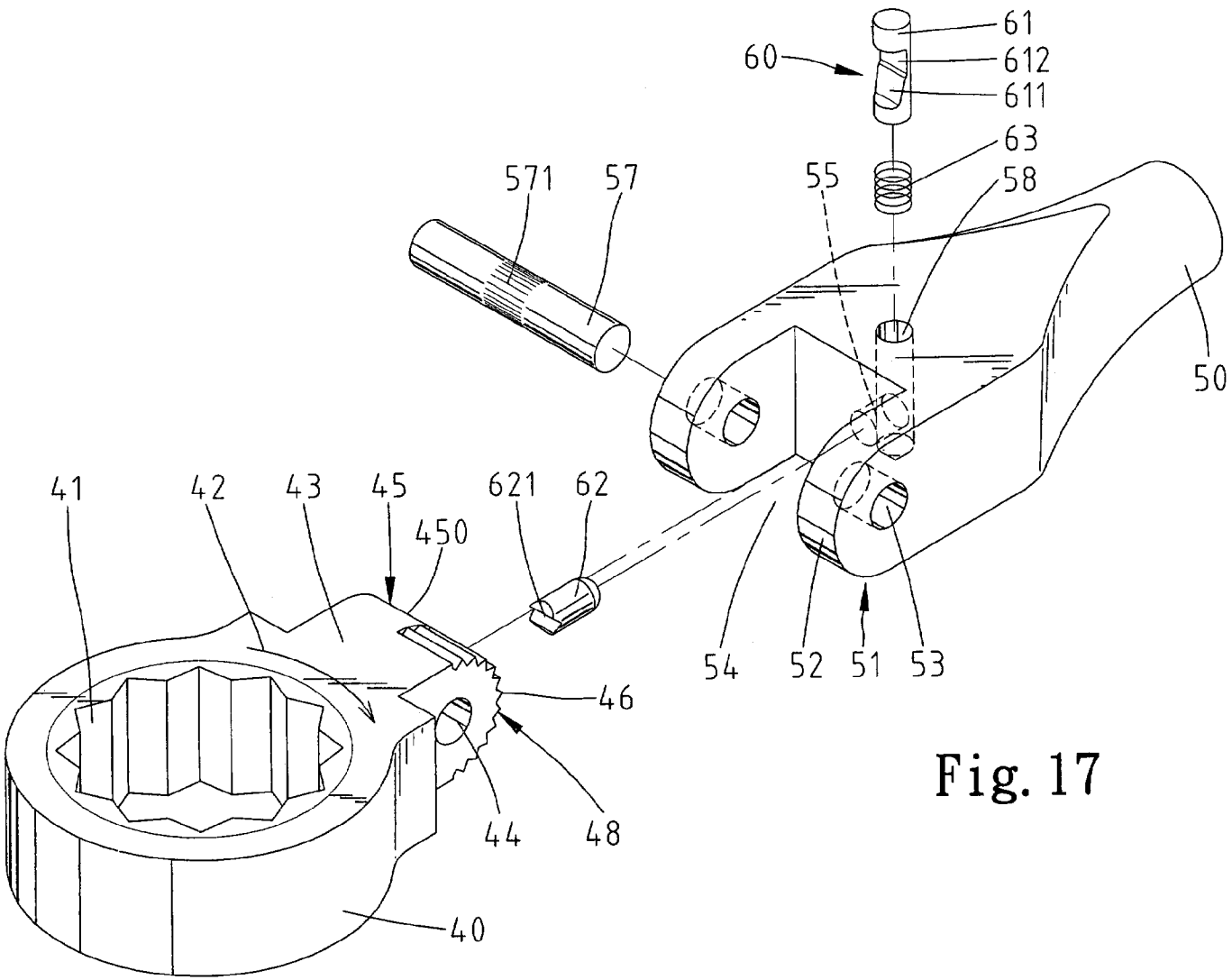
FIG. 17 is an exploded perspective view of the wrench in FIG. 16.

FIGS. 16 and 17 illustrate a further modified embodiment of the wrench. In this embodiment, the receptacle (now designed by 58) is oriented along a vertical direction, and the teeth 48 of the rear part 46 of the pivotal portion 43 may be arcuate teeth, rather than the rectilinear teeth 460 in the previous embodiments.

Although the invention has been explained in relation to its preferred embodiment, it is to be understood that many other possible modifications and variations can be made without departing from the scope of the invention as hereinafter claimed.

What is claimed is:

1. A wrench comprising:

a handle having an end;

a head including a pivotal portion pivotably connected to the end of the handle; and a retaining mechanism for allowing the head to be pivotally moved to a desired position relative to the handle and retaining the head in the desired position;

the pivotal portion of the head including a fore part and a rear part with reference to a ratcheting direction of the handle, the fore part including an arcuate outer surface section, the rear part including a toothed section having a plurality of teeth, the toothed section having a dedendum circle located inside an area delimited by the arcuate outer surface section.

2. The wrench as claimed in claim 1, wherein the end of the handle includes a pair of spaced apart lugs, the pivotal portion of the head including a pin hole, with a pin extending through the lugs and the pin hole of the pivotal portion.

3. The wrench as claimed in claim 1, wherein the end of the handle includes a receptacle extending in a direction perpendicular to a longitudinal direction of the handle, an axial hole being defined in the end of the handle and communicated with the receptacle, the retaining mechanism including an elastic element and a push member mounted in the receptacle, the retaining mechanism further having a catch slidably mounted in the axial hole, the catch being urged by the push member, under an action of the elastic element, to be engaged with the toothed portion of the pivotal portion of the head.

4. The wrench as claimed in claim 3, wherein the push member includes a recessed portion having a first face and a second face that is located in a level different than that of the first face.

5. The wrench as claimed in claim 1, wherein the head includes a mark for indicating the ratcheting direction.

6. The wrench as claimed in claim 3, wherein the receptacle opens in one of two lateral sides of the handle.

7. The wrench as claimed in claim 3, wherein the receptacle opens in a top of the handle.

8. The wrench as claimed in claim 1, wherein the toothed portion of the rear part of the pivotal portion has an addendum circle flush with the arcuate outer surface section of the fore part of the pivotal section.

9. The wrench as claimed in claim 1, wherein the toothed portion of the rear part of the pivotal portion has an addendum circle located outside the area delimited by the arcuate outer surface section of the fore part of the pivotal section.

10. A wrench comprising:

a handle having an end;

a head including a pivotal portion pivotally connected to the end of the handle; and a retaining mechanism for allowing the head to be pivotably moved to a desired position relative to the handle and retaining the head in the desired position;

the pivotal portion of the head including a first part and a second part, the first part including an arcuate outer surface section, the second part including a toothed section having a plurality of teeth, the toothed section having a dedendum circle located inside an area delimited by the arcuate outer surface section.

11. The head as claimed in claim 10, wherein the end of the handle includes a pair of spaced apart lugs, the pivotal portion of the head including a pin hole, with a pin extending through the lugs and the pin hole of the pivotal portion.

12. The wrench as claimed in claim 10, wherein the end of the handle includes a receptacle extending in a direction perpendicular to a longitudinal direction of the handle, an axial hole being defined in the end of the handle and communicated with the receptacle, the retaining mechanism including an elastic element and a push member mounted in the receptacle, the retaining mechanism further having a catch slidably mounted in the axial hole, the catch being urged by the push member, under an action of the elastic element, to be engaged with the toothed portion of the pivotal portion of the head.

13. The wrench as claimed in claim 12, wherein the push member includes a recessed portion having a first face and a second face that is located in a level different than that of the first face.

14. The wrench as claimed in claim 10, wherein the head includes a mark for indicating a ratcheting direction of the handle.

15. The wrench as claimed in claim 10, wherein the toothed portion of the second part of the pivotal portion has an addendum circle flush with the arcuate outer surface section of the first part of the pivotal section.

16. The wrench as claimed in claim 10, wherein the toothed portion of the second part of the pivotal portion has an addendum circle located outside the area delimited by the arcuate outer surface section of the first part of the pivotal section.

17. A head for a handle of a wrench, the head including a pivotal portion pivotally connected to an end of the handle, the pivotal portion of the head including a first part and a second part, the first part including an arcuate outer surface section, the second part including a toothed section having a plurality of teeth, the toothed section having a dedendum circle located inside an area delimited by the arcuate outer surface section.

18. The wrench as claimed in claim 17, wherein the toothed portion of the second part of the pivotal portion has an addendum circle flush with the arcuate outer surface section of the first part of the pivotal section.

19. The wrench as claimed in claim 17, wherein the toothed portion of the second part of the pivotal portion has an addendum circle located outside the area delimited by the arcuate outer surface section of the first part of the pivotal section.

* * * * *